US010114316B2

(12) United States Patent
Mizuno

(10) Patent No.: US 10,114,316 B2
(45) Date of Patent: Oct. 30, 2018

(54) IMAGE FORMING APPARATUS

(71) Applicant: KONICA MINOLTA, INC., Chiyoda-ku, Tokyo (JP)

(72) Inventor: Kyoichi Mizuno, Tama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/867,133

(22) Filed: Jan. 10, 2018

(65) Prior Publication Data

US 2018/0196376 A1 Jul. 12, 2018

(30) Foreign Application Priority Data

Jan. 10, 2017 (JP) ..... 2017-002014

(51) Int. Cl.
*G03G 15/16* (2006.01)

(52) U.S. Cl.
CPC ..... *G03G 15/1615* (2013.01)

(58) Field of Classification Search
CPC ..... G03G 15/1615; G03G 2215/00143; G03G 2215/00156; G03G 2215/00168
See application file for complete search history.

(56) References Cited

U.S. PATENT DOCUMENTS 5,515,139 A * 5/1996 Hou ..... B65G 39/16 198/807
2010/0158568 A1* 6/2010 Yasumoto ..... G03G 15/0131 399/165
2011/0200343 A1* 8/2011 Matsumoto ..... G03G 15/0131 399/31
2014/0183008 A1* 7/2014 Yasumoto ..... B41J 11/007 198/813

FOREIGN PATENT DOCUMENTS

JP 2004203567 A 7/2004
JP 2006089171 A 4/2006
JP 2011128180 A 6/2011
JP 2013186436 A 9/2013

* cited by examiner

*Primary Examiner* — Sandra Brase
(74) *Attorney, Agent, or Firm* — Cantor Colburn LLP

(57) ABSTRACT

An image forming apparatus includes: an image former that forms a toner image; an intermediate transfer belt that carries the toner image formed by the image former; a first winding corrector that corrects a winding of the intermediate transfer belt; and a second winding corrector that assists the first winding corrector in correcting the winding of the intermediate transfer belt, wherein the second winding corrector includes: an auxiliary roller that stretches the intermediate transfer belt and is supported to be axially movable; and an elastic member that is provided at each of axial ends of the auxiliary roller and urges the auxiliary roller toward an image center position.

8 Claims, 4 Drawing Sheets

IMAGE FORMING APPARATUS

CROSS-REFERENCE TO RELATED APPLICATION

The present application claims priority under 35 U.S.C. § 119 to Japanese Patent Application No. 2017-002014, filed on Jan. 10, 2017, the entire contents of which is incorporated herein by reference.

BACKGROUND

Technological Field

The present invention relates to an image forming apparatus.

Description of the Related Art

Conventionally, image forming apparatuses adopting an electrophotographic system, such as a printer and a copying machine, are widely used. In the image forming apparatus, image forming is generally done based on a print job through a series of processes including development of a latent image carried by a photoreceptor drum into a toner image by means of a developing device, transfer of the developed toner image to a sheet of paper via an intermediate transfer belt, and subsequent fixing of the toner image on the paper sheet by means of a fixing device.

The intermediate transfer belt is supported by being laid over a plurality of rotating bodies such as rollers and under normal conditions, rotates along predetermined longitudinal positions of the rotating bodies without deviating. However, there are cases where the intermediate transfer belt travels windingly, deviating longitudinally of the rotating bodies when the rotating bodies are deformed as a result of, for example, their mounting positions and degradation over time. Such windings of the intermediate transfer belt can cause image distortion and failure in superposition of colored images that deteriorate print quality.

Techniques described below are known to correct a winding of the intermediate transfer belt. There is, for example, this technique that corrects the winding of the intermediate transfer belt by providing a steering roller that stretches the intermediate transfer belt and tilting the steering roller according to the winding of the intermediate transfer belt. There is also a technique that controls a widthwise winding of the intermediate transfer belt by providing widthwise ends of the intermediate transfer belt with respective flanges.

With the method of correcting the winding by means of the steering roller or the flanges, winding correction has problematically been insufficient in cases where the intermediate transfer belt has been longitudinally (peripherally) long or has traveled at high speed.

In regards to such a problem, JP 2004-203567 A discloses a belt driving device that is provided with in addition to a steering roller, a winding correction sensitivity adjusting means that adjusts belt winding correction sensitivity with respect to an angle of inclination of the steering roller. An image forming apparatus disclosed in JP 2011-128180 A has a slip roller that is disposed upstream of a steering roller, and a brake mechanism that can apply a brake to and release the brake on the slip roller in order to allow a belt member to travel stably with a small amount of deviation that is achieved through a prompt offset against an amount of deviation caused to the belt member.

In the winding correction method described in JP 2004-203567 A or the like, not only does a roller or the like need to be provided separately from the steering roller, but control including driving of such a mechanism is required too. As such, the control and the mechanism have problematically become complicated. In addition, another drive unit including a motor and a gear is required for carrying out that control, thus problematically leading to increase in size of an apparatus.

SUMMARY

The present invention has been made in view of the problems discussed above, and an object of the present invention is to provide an image forming apparatus that can correct a winding of an intermediate transfer belt without fail.

To achieve the abovementioned object, according to an aspect of the present invention, an image forming apparatus reflecting one aspect of the present invention comprises: an image former that forms a toner image; an intermediate transfer belt that carries the toner image formed by the image former; a first winding corrector that corrects a winding of the intermediate transfer belt; and a second winding corrector that assists the first winding corrector in correcting the winding of the intermediate transfer belt, wherein the second winding corrector includes: an auxiliary roller that stretches the intermediate transfer belt and is supported to be axially movable; and an elastic member that is provided at each of axial ends of the auxiliary roller and urges the auxiliary roller toward an image center position.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more preferred embodiments of the present invention will be described in detail with reference to the drawings. However, the scope of the invention is not limited to the disclosed embodiments. It is to be noted that dimension ratios of the drawings are greater for convenience of explanation and can differ from actual dimension ratios.

First Embodiment

[Structural Example of Image Forming Apparatus 100]

Figure 1:
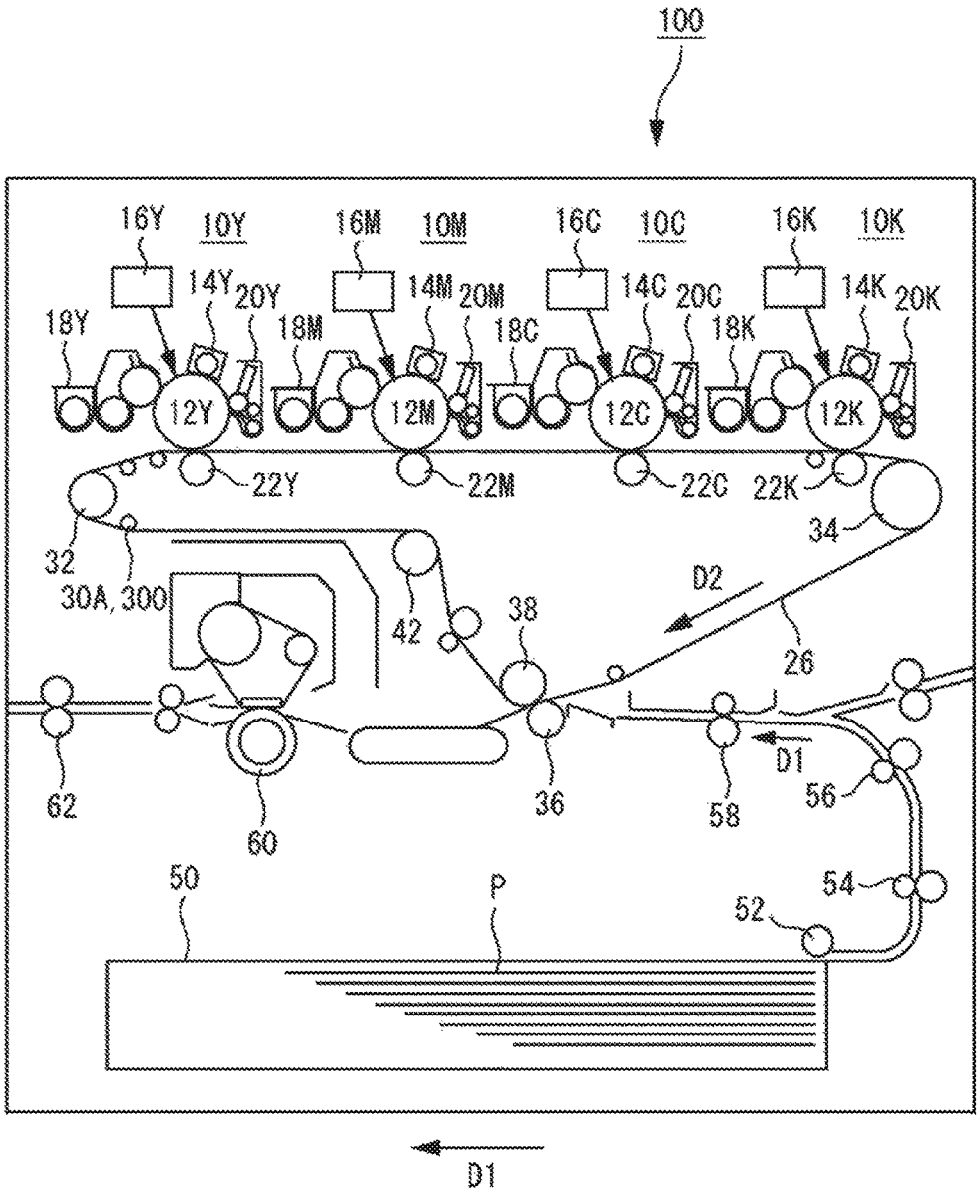
FIG. 1 shows a structural example of an image forming apparatus according to a first embodiment of the present invention.
Figure 2:
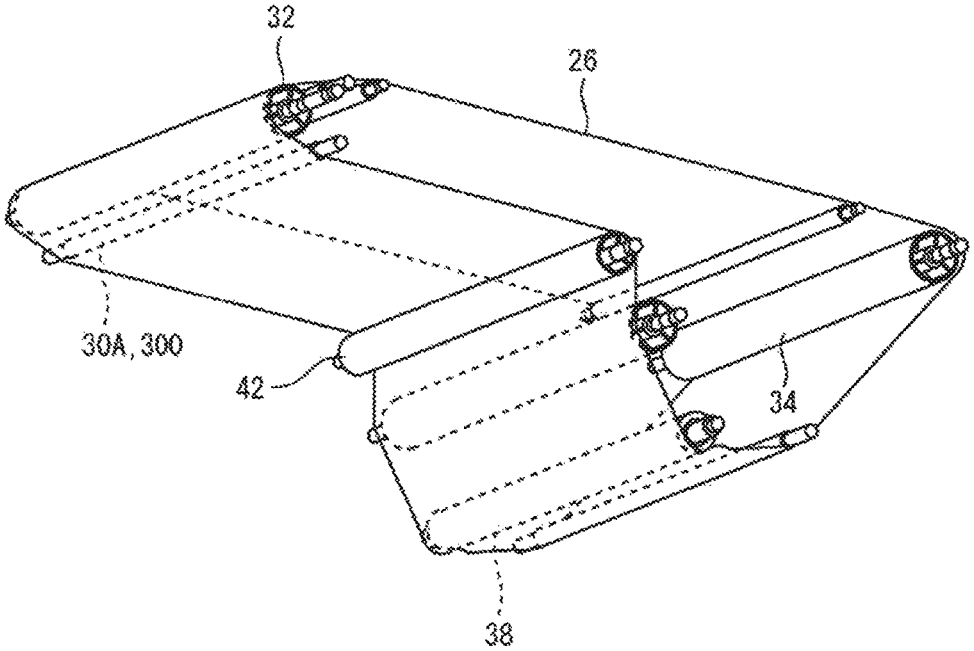
FIG. 2 shows a structural example of an intermediate transfer belt and rollers stretching the intermediate transfer belt according to the first embodiment.

FIG. 1 shows a structural example of an image forming apparatus 100 using an electrophotographic system according to the first embodiment of the present invention. FIG. 2 shows a structural example of an intermediate transfer belt 26 and a steering roller 32 and others that stretch the intermediate transfer belt 26.

As shown in FIGS. 1 and 2, the image forming apparatus 100 is called a tandem-type image forming apparatus and includes image formers 10Y, 10M, 10C, 10K, the intermediate transfer belt 26, a winding correction assist mechanism 30A, a secondary transfer roller 36, a fixing device 60, and a paper feed tray 50.

The image formers 10Y, 10M, 10C, 10K adopt the electrophotographic system and are arranged in an extending direction of the intermediate transfer belt 26. It is to be noted that the image formers 10Y, 10M, 10C, 10K are substantially of the same structure, except that the image formers 10Y, 10M, 10C, 10K use respective toners of different colors including yellow, magenta, cyan, and black. As such, only the structure of the image former 10Y is described below as a representative, and descriptions of the other image formers 10M, 10C, 10K are simplified.

The image former 10Y includes a photoreceptor drum 12Y, a charger 14Y, an exposure unit (optical writing unit) 16Y, a developing unit 18Y, a cleaning unit 20Y, and a primary transfer roller 22Y. The charger 14Y uniformly electrifies a surface of the photoreceptor drum 12Y. The exposure unit 16Y is formed of, for example, an LED print head (LPH) having an LED array and imaging lenses or a laser exposure scanning apparatus using a polygon mirror. Based on an image information signal, the exposure unit 16Y forms an electrostatic latent image on the photoreceptor drum 12Y by means of a laser beam scan. The developing unit 18Y develops the electrostatic latent image formed on the photoreceptor drum 12Y by using the toner, thus forming a visible toner image. The cleaning unit 20Y recovers residual toner on the photoreceptor drum 12Y by allowing a blade to slide on the surface of the photoreceptor drum 12Y. The primary transfer roller 22Y primarily transfers the Y-colored toner image carried by the surface of the photoreceptor drum 12Y to an image forming area of the intermediate transfer belt 26.

The image former 10M includes a photoreceptor drum 12M, a charger 14M, an exposure unit 16M, a developing unit 18M, a cleaning unit 20M, and a primary transfer roller 22M. In the image former 10M, an M-colored toner image is formed on a surface of the photoreceptor drum 12M by means of the exposure unit 16M, the developing unit 18M, and others, and the toner image formed is primarily transferred to the image forming area of the intermediate transfer belt 26.

The image former 10C includes a photoreceptor drum 12C, a charger 14C, an exposure unit 16C, a developing unit 18C, a cleaning unit 20C, and a primary transfer roller 22C. In the image former 10C, a C-colored toner image is formed on a surface of the photoreceptor drum 12C by means of the exposure unit 16C, the developing unit 18C, and others, and the toner image formed is primarily transferred to the image forming area of the intermediate transfer belt 26.

The image former 10K includes a photoreceptor drum 12K, a charger 14K, an exposure unit 16K, a developing unit 18K, a cleaning unit 20K, and a primary transfer roller 22K. In the image former 10K, a K-colored toner image is formed on a surface of the photoreceptor drum 12K by means of the exposure unit 16K, the developing unit 18K, and others, and the toner image formed is primarily transferred to the image forming area of the intermediate transfer belt 26.

The intermediate transfer belt 26 is formed of an endless belt made of, for example, polyimide resin. The intermediate transfer belt 26 is stretched by, for example, the primary transfer rollers 22Y, 22M, 22C, 22K, an auxiliary roller 300 that is a component of an example of the winding correction assist mechanism 30A, the steering roller 32, a driving roller 34, a counter secondary transfer roller 38, and a bending roller 42 and rotates in a traveling direction D2 indicated by an arrow. The colored toner images respectively formed by the image formers 10Y, 10M, 10C, 10K are transferred to the image forming area of the intermediate transfer belt 26 in superposed relation.

The steering roller 32 is formed of a slender cylinder made of, for example, a metal material. The steering roller 32 has one end rotatably mounted to a first bearing and another end rotatably mounted to a second bearing that is movably provided. The steering roller 32 corrects a winding of the intermediate transfer belt 26 by such tilting that the second bearing moves with the first bearing being a point of support. It is to be noted that the steering roller 32 corresponds to an example of a first winding corrector.

The driving roller 34 is connected to a driving motor that is not shown and is rotationally driven based on driving of this driving motor to allow the intermediate transfer belt 26 to travel (rotate) in the direction of arrow D2. It is to be noted that operation of the driving motor is controlled by a controller that is not shown.

The bending roller 42 is disposed between the steering roller 32 and the counter secondary transfer roller 38 and is positioned inwardly of a virtual line connecting the steering roller 32 and the counter secondary transfer roller 38. This is to achieve size reduction of the image forming apparatus 100 by placing the fixing device 60 further inward in the apparatus 100. The bending roller 42 exteriorly presses the intermediate transfer belt 26 inward to tension the intermediate transfer belt 26.

The paper feed tray 50 accommodates a plurality of sheets of paper P such as A3-sized paper or A4-sized paper. As a job begins, the sheets of paper P are taken one by one out of the paper feed tray 50 by a pickup roller 52, and the paper sheet P taken out is conveyed by, for example, conveying rollers 54, 56 to a registration roller 58. The registration roller 58 corrects a skew of the paper sheet P conveyed with respect to a paper conveying direction D1 by causing a leading edge of the paper sheet P to abut against the registration roller 58 for formation of a loop and conveys the paper sheet P to the secondary transfer roller 36 with a predetermined timing.

The secondary transfer roller 36 abuts against the intermediate transfer belt 26 that has its inner surface supported by the counter secondary transfer roller 38, whereby a secondary transfer unit is formed. The secondary transfer roller 36 transfers the toner images that are formed on the intermediate transfer belt 26 in superposed relation to a front side of the paper sheet P conveyed by the registration roller 58.

The fixing device 60 includes a pressure roller and a heating roller. The fixing device 60 applies pressure and heat to the paper sheet P having the toner images transferred by the secondary transfer roller 36, thereby fixing the toner images on the paper sheet P. The paper sheet P that has undergone the fixing at the fixing device 60 is ejected by a paper delivery roller 62 onto a paper output tray that is not shown.

It is to be noted that since a publicly known technique can be adopted as a reversing path that is used for formation of an image on a back side of the paper sheet P, the reversing path is omitted from FIG. 1 for convenience sake. It is also to be noted that the number of paper feed trays 50 is not limited to one. Moreover, one or more large-capacity paper feeders capable of accommodating the paper P in quantity may be connected on an as needed basis.

[Structural Example of Winding Correction Assist Mechanism 30A]

Figure 3:
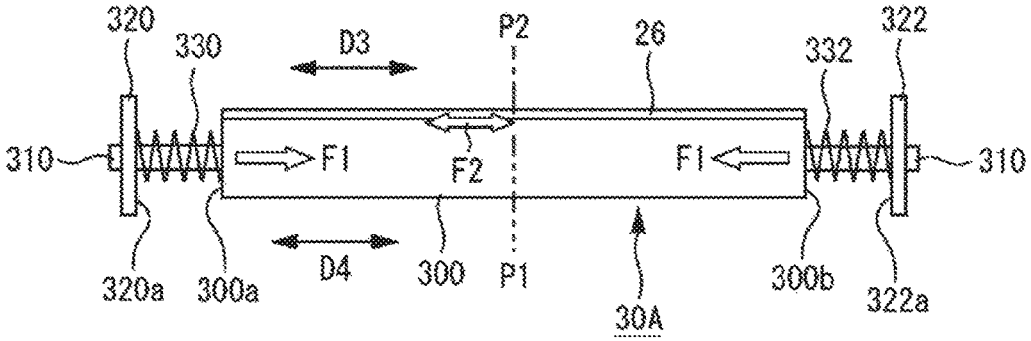
FIG. 3 shows a structural example of a winding correction assist mechanism according to the first embodiment.

FIG. 3 shows a structural example of the winding correction assist mechanism 30A according to the first embodiment of the present invention. In FIG. 3, a right side of the auxiliary roller 300 is a deep side of the apparatus 100, while a left side of the auxiliary roller 300 is a front side of the apparatus 100. In the following, the intermediate transfer belt 26 has a width D3 along a direction orthogonal to the traveling direction D2, and the auxiliary roller 300 has an axis D4 along its length. In the present embodiment, the width D3 and the axis D4 have the same direction.

The winding correction assist mechanism 30A is a mechanism that assists a function of the steering roller 32 in correcting a winding of the intermediate transfer belt 26 and is disposed upstream of the steering roller 32 in the traveling direction D2 of the intermediate transfer belt 26 (see FIG. 2). As shown in FIG. 3, the winding correction assist mechanism 30A includes the auxiliary roller 300, support members 320, 322, and urging springs 330, 332. It is to be noted that the winding correction assist mechanism 30A corresponds to an example of a second winding corrector.

The auxiliary roller 300 is made of, for example, a resin material such as rubber and is formed of a cylindrical body having a length that is substantially equal to the width D3 of the intermediate transfer belt 26. This auxiliary roller 300 is mounted to a rotating shaft 310 and is supported to be movable along the axis D4 according to a winding of the intermediate transfer belt 26. A peripheral surface of the auxiliary roller 300 partly abuts against the inner surface of the intermediate transfer belt 26, whereby the intermediate transfer belt 26 is stretched by predetermined tension.

The support member 320 is disposed at a fixed distance from one axial end face 300*a* of the auxiliary roller 300. The support member 322 is disposed at a fixed distance from another axial end face 300*b* of the auxiliary roller 300. These support members 320, 322 are fixed to a housing (not shown) of an apparatus body and rotatably support ends of the rotating shaft 310 of the auxiliary roller 300, respectively.

The urging spring 330 is mounted over the rotating shaft 310 between the axial end face 300*a* of the auxiliary roller 300 and an inner face 320*a* of the support member 320 and urges the end face 300*a* of the auxiliary roller 300 toward a middle (an inner part) of the axis D4. The urging spring 332 is mounted over the rotating shaft 310 between the axial end face 300*b* of the auxiliary roller 300 and an inner face 322*a* of the support member 322 and urges the end face 300*b* of the auxiliary roller 300 toward the middle (the inner part) of the axis D4. It is to be noted that the urging spring 330, 332 corresponds to an example of an elastic member.

Here elastic force (spring force) F1 of the urging spring 330, 332 is adjusted to align a center position P1 that is an axial reference position of the auxiliary roller 300 with a center position P2 (image center position) that is a widthwise reference position of the intermediate transfer belt 26. For prevention of a shift between the center position P1 of the auxiliary roller 300 and the center position P2 of the traveling intermediate transfer belt 26, the spring force F1 of the urging spring 330, 332 and frictional force F2 between the auxiliary roller 300 and the intermediate transfer belt 26 satisfy the relationship: spring force F1<frictional force F2. It is to be noted that each of the center positions P1, P2 is preferably provided with a mark such as a patch.

In the above case, a resin material having a higher coefficient of friction, such as rubber, is preferably used for the auxiliary roller 300 for the purpose of increasing the frictional force F2. As an alternative, the peripheral surface of the auxiliary roller 300 may undergo blasting or may be formed with irregularities for an increased area of contact with the intermediate transfer belt 26, thereby increasing a coefficient of friction of the auxiliary roller 300. A material having a high coefficient of friction can be used for the intermediate transfer belt 26, or both the auxiliary roller 300 and intermediate transfer belt 26 can use respective materials each having a high coefficient of friction.

According to the first embodiment, even in cases where the intermediate transfer belt 26 winds during execution of a job, the auxiliary roller 300 making close contact with the intermediate transfer belt 26 rocks along the axis D4 according to the winding of the intermediate transfer belt 26. Here ends of the auxiliary roller 300 are urged inward by the urging springs 330, 332, respectively. As such, the auxiliary roller 300 is acted upon by force to be restored to the image center position, and the intermediate transfer belt 26 making close contact with the auxiliary roller 300 also is acted upon by force accordingly to be restored to the image center position. In this condition, the intermediate transfer belt 26 passes the steering roller 32 downstream. Accordingly, the steering roller 32 can correct the winding or deviation of the intermediate transfer belt 26 with a minimum of movement, force, and time, thus enabling further improvement in accuracy and sensitivity of winding correction. Stable winding correction can be achieved even with particular use of the bending roller 42 where a larger winding is caused easily.

In the first embodiment, the auxiliary roller 300 upstream from the steering roller 32 in the traveling direction D2 is disposed near the steering roller 32 with a distance between the auxiliary roller 300 and the steering roller 32 set shorter. Thus, the steering roller 32 can carry out winding correction immediately after assisted winding correction by the auxiliary roller 300. Consequently, more effective winding correction of the intermediate transfer belt 26 can be carried out.

The winding correction assist mechanism 30A of the first embodiment requires no complicated electrical control and thus does not need to be provided with another device for such control. As such, simplified control can be achieved while the winding correction that can be achieved is low-cost.

According to the first embodiment, the steering roller 32 is adopted as the first winding corrector, so that excess stress on lateral face 26*a*, 26*b* of the intermediate transfer belt 26 can be prevented. As such, the intermediate transfer belt 26 can have a longer life.

Second Embodiment

A winding correction assist mechanism 30B according to the second embodiment differs from the winding correction assist mechanism 30A of the first embodiment in that respective positions of the support members 320, 322 can be adjusted (moved) along the axis D4. It is to be noted that in the second embodiment, constituent elements that have substantially the same functional structures as those of the winding correction assist mechanism 30A of the first embodiment are given the same reference marks, whereby redundancy is omitted from descriptions of those constituent elements.

Figure 4:
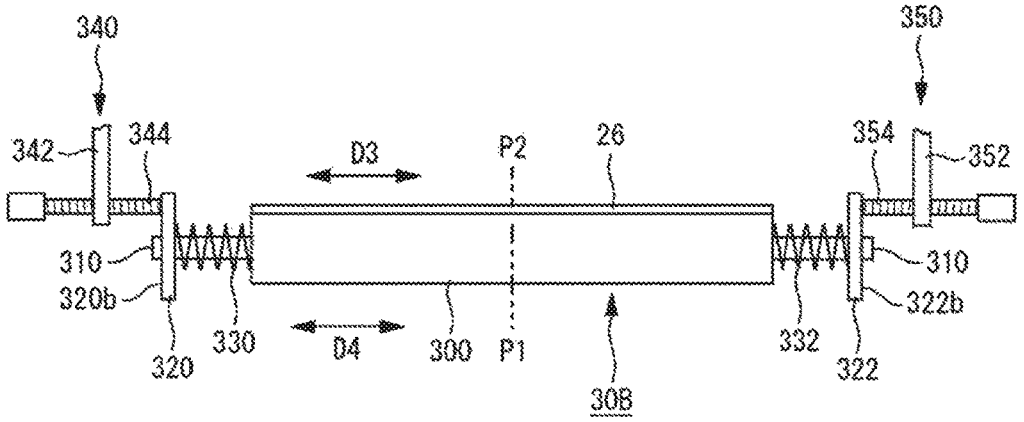
FIG. 4 shows a structural example of a winding correction assist mechanism according to a second embodiment of the present invention.

FIG. 4 shows a structural example of the winding correction assist mechanism 30B according to the second embodiment. In FIG. 4, a right side of the auxiliary roller 300 is a deep side of the apparatus 100, while a left side of the auxiliary roller 300 is a front side of the apparatus 100.

As shown in FIG. 4, the winding correction assist mechanism 30B includes in addition to the aforementioned auxiliary roller 300, the support members 320, 322, and the urging springs 330, 332, adjustment mechanisms 340, 350 that respectively adjust the respective positions of the support members 320, 322 along the axis D4.

The adjustment mechanism 340 includes a support member 342 and an adjusting screw 344. The support member 342 is disposed outwardly of the support member 320 and is fixed to a housing (not shown) of the apparatus body. The adjusting screw 344 is mounted through a screw hole that is formed in the support member 342 and abuts on an end face 320*b* of the support member 320 at one end while another end of the adjusting screw 344 functions as a holding part that is held by an operator. The support member 320 can be moved depth-ward or frontward in the apparatus 100 by, for example, clockwise or counterclockwise turning of the adjusting screw 344.

The adjustment mechanism 350 includes a support member 352 and an adjusting screw 354. The support member 352 is disposed outwardly of the support member 322 and is fixed to a housing (not shown) of the apparatus body. The adjusting screw 354 is mounted through a screw hole that is formed in the support member 352 and abuts on an end face 322*b* of the support member 322 at one end while another end of the adjusting screw 354 functions as a holding part that is held by the operator. The support member 322 can be moved depth-ward or frontward in the apparatus 100 by, for example, clockwise or counterclockwise turning of the adjusting screw 354.

According to the second embodiment, even in cases where, for example, there is shift between the center position P1 of the auxiliary roller 300 and the center position P2 of the intermediate transfer belt 26, the auxiliary roller 300 can be positionally adjusted along the axis D4 in a stage of shipment of the image forming apparatus 100 through operation of the adjustment mechanism 340, 350. When, for example, the center position P1 of the auxiliary roller 300 is shifted to the front side of the apparatus 100 with respect to the center position P2 of the intermediate transfer belt 26, the adjusting screw 344 of the adjustment mechanism 340 is turned to move the support member 320 depth-ward in the apparatus 100, whereby the center position P1 of the auxiliary roller 300 can be brought into alignment with the center position P2 of the intermediate transfer belt 26. Consequently, the auxiliary roller 300 and the intermediate transfer belt 26 can be adjusted to the image center position, which is the reference position. As such, even when the auxiliary roller 300 is moved frontward or depth-ward in the apparatus 100 because of its close contact with the intermediate transfer belt 26, the auxiliary roller 300 is always acted upon by force to be restored to the precise image center position, so that the intermediate transfer belt 26 can be corrected accurately for its winding.

In the example described in the second embodiment, the operator moves the auxiliary roller 300 along the axis D4 by hand. However, this example is not restrictive. For example, the adjustment mechanism 340, 350 may be formed of, for example, a motor, an actuator, and a cam so that the auxiliary roller 300 can be moved automatically along the axis D4. In this case, an amount of movement of the auxiliary roller 300 can be adjusted by, for example, an operation panel (not shown) that is provided to the image forming apparatus 100 or an operating unit of a computer that is connected to the image forming apparatus 100 via a network. The positional adjustment between the auxiliary roller 300 and the intermediate transfer belt 26 may be carried out as required even after the shipment.

Third Embodiment

A winding correction assist mechanism 30C according to the third embodiment differs from, for example, the winding correction assist mechanism 30A of the first embodiment in that a press mechanism 360 is provided to improve tracking ability (adhesion) of the auxiliary roller 300 with respect to the intermediate transfer belt 26. It is to be noted that in the third embodiment, constituent elements that have substantially the same functional structures as those of, for example, the winding correction assist mechanism 30A of the first embodiment are given the same reference marks, whereby redundancy is omitted from descriptions of those constituent elements.

Figure 5:
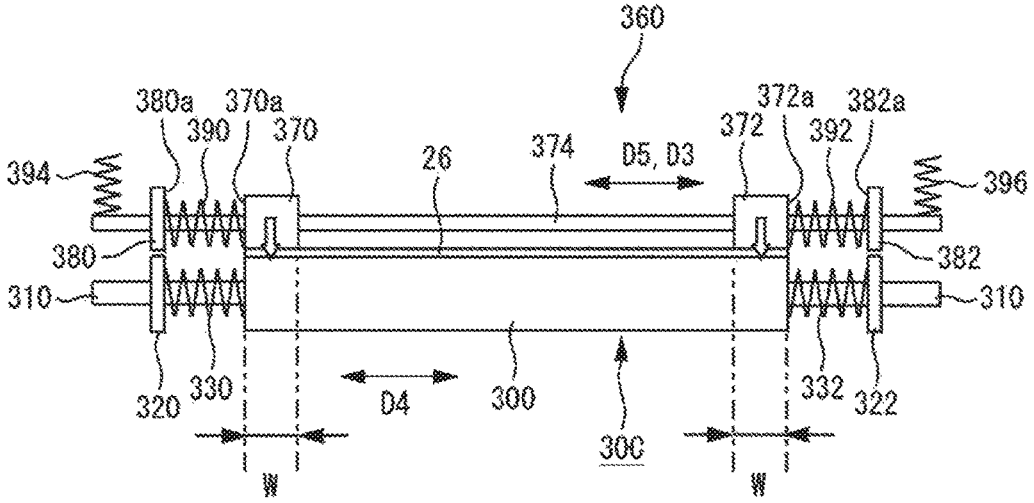
FIG. 5 shows a structural example of a winding correction assist mechanism according to a third embodiment of the present invention.

FIG. 5 shows a structural example of the winding correction assist mechanism 30C according to the third embodiment of the present invention. In the following, the press mechanism 360 has an axis D5 along respective lengths of its rollers, and the axis D5, the axis D4 of the auxiliary roller 300, and the other have the same direction.

As shown in FIG. 5, the winding correction assist mechanism 30C includes the press mechanism 360 in addition to the aforementioned auxiliary roller 300, the support members 320, 322, and the urging springs 330, 332. The press mechanism 360 includes nip rollers 370, 372, pressing springs 394, 396, and urging springs 390, 392.

The nip rollers 370, 372 are disposed at respective ends of the axis D5 in respective non-image forming areas of the intermediate transfer belt 26. Each of the nip rollers 370, 372 is formed to have an axial length that is not more than a widthwise length W of the non-image forming area of the intermediate transfer belt 26. It is to be noted that the nip roller 370, 372 corresponds to an example of a press roller. Support members 380, 382 are provided outwardly of the respective nip rollers 370, 372. Ends of a rotating shaft 374 that is mounted with the nip rollers 370, 372 are rotatably supported by the support members 380, 382, respectively.

The pressing spring 394 has one end mounted to one of the ends of the rotating shaft 374 and another end fixed to a housing (not shown) of the apparatus body. The pressing spring 396 has one end mounted to the other end of the rotating shaft 374 and another end fixed to a housing (not shown) of the apparatus body. The pressing springs 394, 396 respectively urge the ends of the rotating shaft 374 toward the auxiliary roller 300 to press the intermediate transfer belt 26 against the auxiliary roller 300, thereby forming respective nips with the auxiliary roller 300 via the intermediate transfer belt 26.

The urging spring 390 is mounted over the rotating shaft 374 between an end face 370*a* of the nip roller 370 and an inner face 380*a* of the support member 380 and urges the nip roller 370 toward a middle of the axis D5. The urging spring 392 is mounted over the rotating shaft 374 between an end face 372*a* of the nip roller 372 and an inner face 382*a* of the support member 382 and urges the nip roller 372 toward the middle of the axis D5. Such a structure enables the nip rollers 370, 372 to rock along the axis D5. It is to be noted that the urging spring 390, 392 corresponds to an example of an elastic member.

According to the third embodiment, the nip rollers 370, 372 press (urge) the intermediate transfer belt 26 against the auxiliary roller 300, so that improved adhesion can be achieved between the auxiliary roller 300 and the intermediate transfer belt 26. Moreover, adhesion can be ensured even in cases where the intermediate transfer belt 26 is wound onto the auxiliary roller 300 at a small angle. In this way, a winding correction function of the auxiliary roller 300 can be improved. Similarly to the auxiliary roller 300, the nip rollers 370, 372 are urged inward by the springs 390, 392, respectively, so that even the nip rollers 370, 372 can assist in correcting a winding of the intermediate transfer belt 26.

Fourth Embodiment

A winding correction assist mechanism 30D according to the fourth embodiment differs from, for example, the winding correction assist mechanism 30A of the first embodiment in that flange parts 312, 314 are provided to prevent a positional shift between the auxiliary roller 300 and the intermediate transfer belt 26. It is to be noted that in the fourth embodiment, constituent elements that have substantially the same functional structures as those of, for example, the winding correction assist mechanism 30A of the first embodiment are given the same reference marks, whereby redundancy is omitted from descriptions of those constituent elements.

Figure 6:
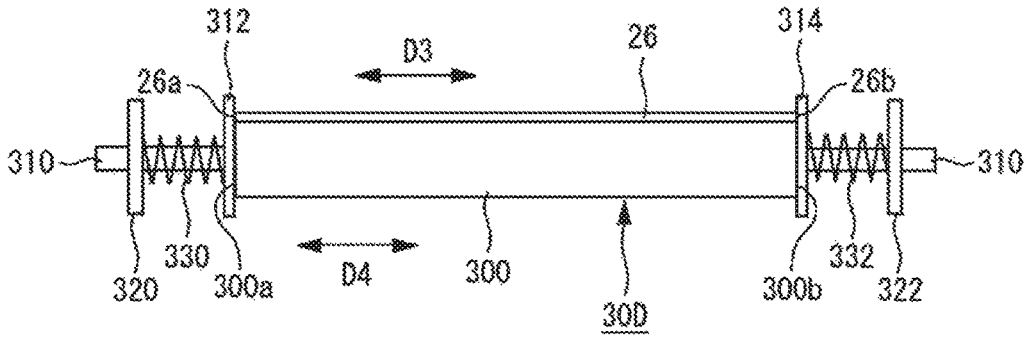
FIG. 6 shows a structural example of a winding correction assist mechanism according to a fourth embodiment of the present invention.

FIG. 6 shows a structural example of the winding correction assist mechanism 30D according to the fourth embodiment of the present invention. As shown in FIG. 6, the winding correction assist mechanism 30D includes the flange parts 312, 314 in addition to the aforementioned auxiliary roller 300, the support members 320, 322, and the urging springs 330, 332. It is to be noted that the flange part 312, 314 corresponds to an example of a restricting member.

The flange part 312 is, for example, of disk shape and is mounted to the end face 300*a* of the auxiliary roller 300 at its inner face. The flange part 312 juts out from a periphery of the end face 300*a* of the auxiliary roller 300, and its jutting part abuts the lateral face 26*a* of the intermediate transfer belt 26. The urging spring 330 is mounted over the rotating shaft 310 between the flange part 312 and the support member 320 and urges the auxiliary roller 300 toward the middle of the axis D4 via the flange part 312.

The flange part 314 is, for example, of disk shape and is mounted to the end face 300*b* of the auxiliary roller 300 at its inner face. The flange part 314 juts out from a periphery of the end face 300*b* of the auxiliary roller 300, and its jutting part abuts the lateral face 26*b* of the intermediate transfer belt 26. The urging spring 332 is mounted over the rotating shaft 310 between the flange part 314 and the support member 322 and urges the auxiliary roller 300 toward the middle of the axis D4 via the flange part 314.

According to the fourth embodiment, even in cases where the intermediate transfer belt 26 is about to wind to experience a great shift along the axis D4 with respect to the auxiliary roller 300, the intermediate transfer belt 26 abuts against the flange part 312, 314, thereby having its widthwise movement restricted. In this way, the intermediate transfer belt 26 can be prevented from being, for example, corrugated, and the auxiliary roller 300 can have improved tracking ability (adhesion) with respect to the intermediate transfer belt 26. Accordingly, even in cases where the intermediate transfer belt 26 is wound onto the auxiliary roller 300 at a small angle, a winding of the intermediate transfer belt 26 can be suppressed effectively.

Fifth Embodiment

A winding correction assist mechanism 30E according to the fifth embodiment differs from, for example, the winding correction assist mechanism 30A of the first embodiment in that assisted winding correction of the intermediate transfer belt 26 is carried out only when the intermediate transfer belt 26 winds beyond a correction limit of the first winding corrector. It is to be noted that in the fifth embodiment, constituent elements that have substantially the same functional structures as those of, for example, the winding correction assist mechanism 30A of the first embodiment are given the same reference marks, whereby redundancy is omitted from descriptions of those constituent elements.

Figure 7:
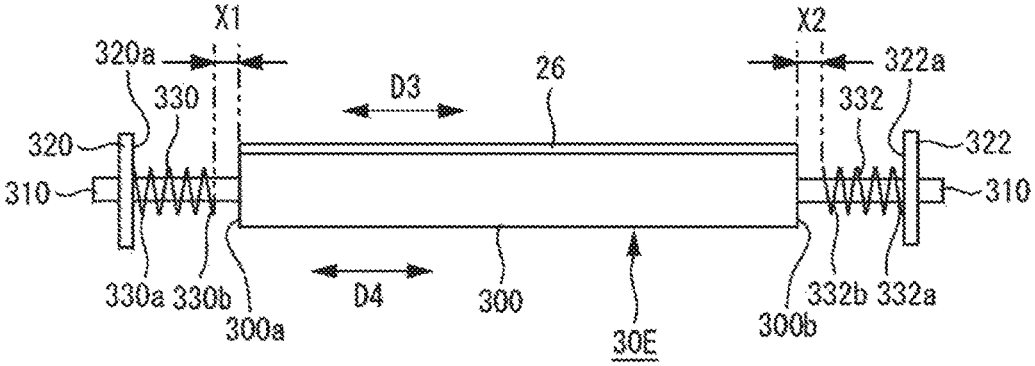
FIG. 7 shows a structural example of a winding correction assist mechanism according to a fifth embodiment of the present invention.

FIG. 7 shows a structural example of the winding correction assist mechanism 30E according to the fifth embodiment of the present invention. In FIG. 7, a right side of the auxiliary roller 300 is a deep side of the apparatus 100, while a left side of the auxiliary roller 300 is a front side of the apparatus 100.

Similarly to the winding correction assist mechanism 30A of the first embodiment, the winding correction assist mechanism 30E includes, as shown in FIG. 7, the auxiliary roller 300, the support members 320, 322, and the urging springs 330, 332.

A counter auxiliary-roller-side end 330*a* of the urging spring 330 is mounted to the inner face 320*a* of the support member 320, while an auxiliary-roller-side end 330*b* of the urging spring 330 is provided at a fixed distance X1 from the end face 300*a* of the auxiliary roller 300. The distance X1 is a correction limit value of the steering roller 32, which is the first winding corrector, meaning that if the intermediate transfer belt 26 moves beyond this distance X1, the winding cannot be corrected only by the steering roller 32.

A counter auxiliary-roller-side end 332*a* of the urging spring 332 is mounted to the inner face 322*a* of the support member 322, while an auxiliary-roller-side end 332*b* of the urging spring 332 is provided at a fixed distance X2 from the end face 300*b* of the auxiliary roller 300. The distance X2 is a correction limit value of the steering roller 32, meaning that if the intermediate transfer belt 26 moves beyond this distance X2, the winding cannot be corrected only by the steering roller 32. It is to be noted that the distance X1 is set equal to the distance X2 in the present embodiment.

The fifth embodiment has effects that are as follows. In cases where a larger winding normally is not caused to the intermediate transfer belt 26, a winding of the intermediate transfer belt 26 is corrected only by the steering roller 32, so that the auxiliary roller 300 is rotationally driven by close contact with the intermediate transfer belt 26 but does not make contact with the urging spring 330, 332.

On the other hand, in cases where the larger winding is caused to the intermediate transfer belt 26, the auxiliary roller 300 moves, for example, frontward in the apparatus 100 and comes into contact with the urging spring 330, whereby the auxiliary roller 300 is urged toward the middle of the axis D4. The intermediate transfer belt 26 also is acted upon by force accordingly to be restored to the image center position, so that the winding of the intermediate transfer belt 26 can be restored to within a permissible range of the steering roller 32 and can be suppressed effectively.

According to the fifth embodiment, the auxiliary roller 300 does not come into contact with the urging spring 330, 332 until the intermediate transfer belt 26 winds beyond the correction limit of the steering roller 32, so that with no larger winding being caused to the intermediate transfer belt 26, the intermediate transfer belt 26 can be subjected to reduced stress. In this way, problems such corrugation of the intermediate transfer belt 26 and transfer failure can be solved.

Although embodiments of the present invention have been described and illustrated in detail, the disclosed embodiments are made for purposes of illustration and example only and not limitation. The scope of the present invention should be interpreted by terms of the appended claims. Various modifications or improvements can be added to the above embodiments without departing from the spirit of the present invention. For example, the example used as the first winding corrector has been the steering roller 32 in the above embodiments but is not limited to this. Flange parts, for example can be adopted as the first winding corrector to restrict movement of the intermediate transfer belt 26 along the width D3.

What is claimed is:

1. An image forming apparatus comprising:

an image former that forms a toner image;

an intermediate transfer belt that carries the toner image formed by the image former;

a first winding corrector that corrects a winding of the intermediate transfer belt; and a second winding corrector that assists the first winding corrector in correcting the winding of the intermediate transfer belt, wherein the second winding corrector includes:

an auxiliary roller that stretches the intermediate transfer belt and is supported to be axially movable; and an elastic member that is provided at each of axial ends of the auxiliary roller and urges the auxiliary roller toward an image center position.

2. The image forming apparatus according to claim 1, wherein the second winding corrector is provided upstream of the first winding corrector in a traveling direction of the intermediate transfer belt.

3. The image forming apparatus according to claim 1, wherein the elastic member urges the auxiliary roller to align an axial reference position of the auxiliary roller with a widthwise reference position that is orthogonal to a traveling direction of the intermediate transfer belt.

4. The image forming apparatus according to claim 1, further comprising:

a press roller that presses the intermediate transfer belt against the auxiliary roller, the press roller being provided in a non-image forming area of the intermediate transfer belt; and an elastic member that supports axial movement of the press roller and urges the press roller.

5. The image forming apparatus according to claim 1, wherein the second winding corrector further includes a restricting member that restricts a widthwise movement that is orthogonal to a traveling direction of the intermediate transfer belt, the restricting member being provided at each of the axial ends of the auxiliary roller.

6. The image forming apparatus according to claim 1, wherein a peripheral surface of the auxiliary roller is formed of rubber material or by blasting.

7. The image forming apparatus according to claim 1, wherein a relationship of $F1<F2$ is satisfied, where F1 is force of the elastic member that urges the auxiliary roller, and F2 is frictional force between the auxiliary roller and the intermediate transfer belt.

8. The image forming apparatus according to claim 1, wherein the elastic member is provided at a fixed distance from the auxiliary roller and urges the auxiliary roller toward the image center position when the intermediate transfer belt winds beyond the fixed distance.

* * * * *